US006145307A

United States Patent [19]

Dantlgraber

[11] Patent Number: 6,145,307

[45] Date of Patent: Nov. 14, 2000

[54] METHOD AND DEVICE FOR CONTROLLING A HYDRAULIC INSTALLATION OF A UTILITY VEHICLE

[75] Inventor: Joerg Dantlgraber, Lohr, Germany

[73] Assignee: Mannesman Rexoth AG, Lohr, Germany

[21] Appl. No.: 09/068,402

[22] PCT Filed: Oct. 11, 1996

[86] PCT No.: PCT/DE96/01934

§ 371 Date: Aug. 4, 1998

§ 102(e) Date: Aug. 4, 1998

[87] PCT Pub. No.: WO97/20146

PCT Pub. Date: Jun. 5, 1997

[30] Foreign Application Priority Data

Nov. 24, 1995 [DE] Germany ..... 195 43 876

[51] Int. Cl.[7] ..... F15B 1/033; F15B 11/036

[52] U.S. Cl. ..... 60/327; 60/414; 91/519

[58] Field of Search ..... 60/327, 414; 91/28, 91/433, 517, 518, 519

[56] References Cited

U.S. PATENT DOCUMENTS

| | | | |
|---|---|---|---|
| 2,869,237 | 1/1959 | Symmank | 91/519 |
| 3,452,397 | 7/1969 | Newton | 91/28 |
| 3,786,725 | 1/1974 | Aoki | 91/519 |
| 4,833,971 | 5/1989 | Kubik | 91/519 |
| 5,090,296 | 2/1992 | Todd | 91/518 |
| 5,353,683 | 10/1994 | Snitgen . | |
| 5,477,677 | 12/1995 | Krnavek | 60/414 |

FOREIGN PATENT DOCUMENTS

| | | | |
|---|---|---|---|
| 0 327 666 A1 | 8/1989 | European Pat. Off. . | |
| 0 499 826 A1 | 8/1992 | European Pat. Off. . | |
| 1 091 435 | 10/1960 | Germany . | |
| 2 220 180 | 11/1973 | Germany . | |
| 22 26 632 B2 | 12/1973 | Germany . | |
| 27 26 246 B2 | 12/1978 | Germany . | |
| 35 21 699 C2 | 4/1986 | Germany . | |
| 37 35 123 A1 | 6/1989 | Germany . | |
| 38 36 371 A1 | 5/1990 | Germany . | |
| 54-84182 | 7/1979 | Japan . | |
| 6-59005 | 5/1981 | Japan | 91/519 |
| 561812 | 9/1975 | U.S.S.R. | 91/28 |
| 2 068 330 | 8/1981 | United Kingdom . | |

*Primary Examiner*—F. Daniel Lopez
*Attorney, Agent, or Firm*—Oliff & Berridge, PLC

[57] ABSTRACT

What is disclosed is a method for controlling a hydraulic cylinder acting against a load, and a hydraulic installation of a utility vehicle operating in accordance with this method, wherein the pressure in the supply line to the effective areas of the hydraulic cylinder is maintained at a level that approximately corresponds to the pressure level in a hydraulic accumulator for supplying the hydraulic installation.

9 Claims, 1 Drawing Sheet

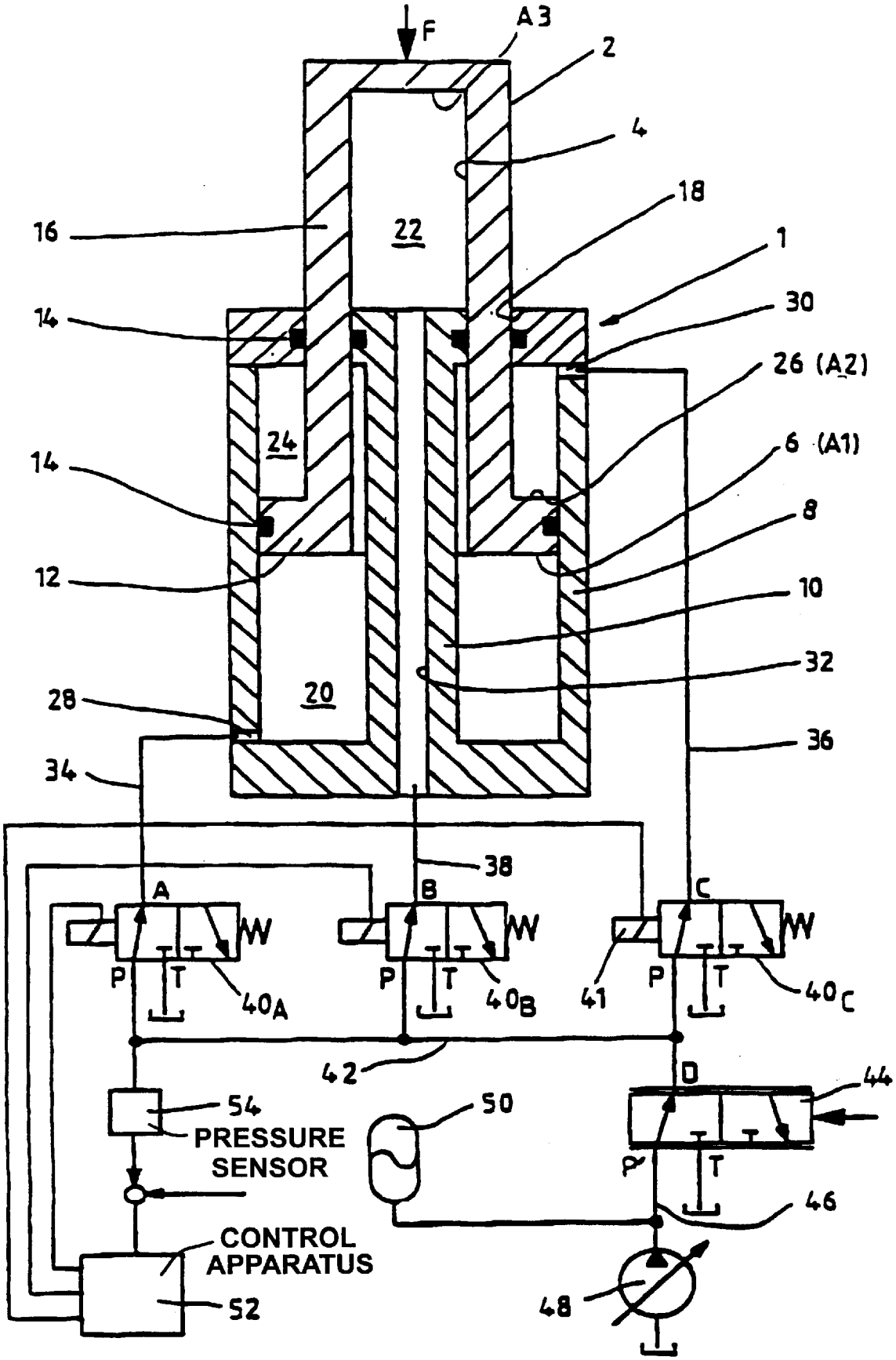
F
A3
2
4
18
16
22
1
14
30
26 (A2)
24
6 (A1)
14
8
12
10
32
20
28
36
34
38
A
B
C
P
T
40A
40B
41
40C
42
D
44
54
PRESSURE
SENSOR
50
P
T
46
CONTROL
APPARATUS
52
48

METHOD AND DEVICE FOR CONTROLLING A HYDRAULIC INSTALLATION OF A UTILITY VEHICLE

The invention relates to a method for controlling a multistage hydraulic cylinder of an implement, that acts on a load, including at least two selectively connectable active areas and being supplied with hydraulic fluid via a hydraulic pump, a hydraulic accumulator and a control valve. The invention also relates to a hydraulic system for an implement, the system including a hydraulic cylinder to which hydraulic fluid is suppliable from a hydraulic accumulator and/or a hydromotor via a control valve for advancing, holding or retracting a piston, wherein the hydraulic cylinder includes several active areas that are selectively controllable for actuating the hydraulic cylinder.

Apart from the hydromotor, hydraulic cylinders are indispensable devices in modern hydraulic installations for transforming hydraulic energy into mechanical energy. In a hydraulic installation, a hydromotor is commonly driven by a motor, and hydraulic fluid is sucked from a tank and conveyed through the pressure line of the hydraulic installation toward the hydraulic cylinder. Via a distributing valve in the pressure line between hydromotor and hydraulic cylinder, the direction of displacement of the piston in the hydraulic cylizider can be controlled. The hydraulic cylinder to which a load is applied constitutes a resistance for the hydraulic fluid, with the pressure in the hydraulic cylinder rising until the resulting force is sufficient to displace the piston against the resistance of the load. The maximum movable force is essentially predetermined by the maximum pump pressure and the effective diameter of the hydraulic cylinder.

The maximum displacemnent velocity of the piston of the hydraulic cylinder depends on the maximum conveyed flow of the hydromotor. For the case that speedy actuating movements of the hydraulic cylinder are required, a high pump performance must be provided. In order to keep the pump performance requirements low, there is provided in the pressure line a hydraulic accumulator which is filled by the pump when, during a work cycle, the volume flow required for advancing the hydraulic cylinder is smaller than the maximum pump volume flow. If in an operating condition the maximum volume flow is required for speedily advancing the hydraulic cylinder, then the difference with the volume flow of the pump may be taken from the hydraulic accumulator. Use of these hydraulic accumulators thus permits to reduce the maximum pump performance. Upon retraction of the hydraulic cylinder, the displaced hydraulic fluid is again conveyed back into the tank, in which case heating occurs owing to throttling of the returning hydraulic fluid. The energy stored in the returning hydraulic fluid is lost practically unused. Inasmuch as constant efforts are directed at minimising energy expenditure as far as possible in modern hydraulic installations, solutions have been proposed wherein the hydraulic pump is designed such as to act, upon retraction of the hydraulic cylinder, as a motor which is driven by the returning hydraulic fluid. Through this hydromotor it is possible e.g. to drive a generator, such that part of the energy stored in the returning hydraulic fluid is transformed into mechanical or electrical energy. Undesirable heating of the hydraulic fluid is moreover prevented as the latter need not be throttled any more.

Owing to the particular configuration of the hydraulic pump, this solution does, however, require considerable expense in terms of device technology and thus increased investment costs.

In contrast, the invention is based on the object of creating a method for controlling a hydraulic cylinder and a hydraulic installation of a utility vehicle, which permit operation of the utility vehicle at minimised energy consumption yet minimum expense in terms of device technology.

This object is achieved by the features of the invention as described below.

Owing to the measure of providing a hydraulic cylinder with a plurality of effective areas and controlling these effective areas of the hydraulic cylinder in dependence on a detected operating pressure in the pressure line, it is possible to adjust the pressure in the pressure line to the hydraulic cylinder such as to approximately correspond to the one of the hydraulic accumulator, so that at least part of the returning hydraulic fluid may be made use of for charging the hydraulic accumulator upon retraction of the hydraulic cylinder. Due to this measure in accordance with the invention, energy consumption of the hydraulic installation can be reduced in comparison with conventional solutions, while requiring only minimum expense in terms of device technology inasmuch as control of the distributing valves may be performed by means of comparatively economical hydraulic or electrical control apparatus.

Optimum energy saving is achieved if, during extension of the hydraulic cylinder, the operating pressure in the pressure line corresponds approximately to the difference between the accumulator pressure and the control pressure difference at the control valve, and during retraction of the hydraulic cylinder, the operating pressure in the pressure line corresponds approximately to the sum of the accumulator pressure and the control pressure difference at the control valve.

It is particularly advantageous if the hydraulic cylinder has three effective areas, two effective areas among which act in the advancing direction and one effective area of which acts in the retracting direction of the hydraulic cylinder or, more precisely, of the piston of the hydraulic cylinder, with an electrically or hydraulically actuatable 3/2-distributing valve being associated with each effective area. The three effective areas may optionally be combined by suitably controlling the distributing valves, such that five pressure stages can be adjusted.

Herein it is particularly advantageous if the effective area ratios are selected, such that five evenly spaced pressure stages may be adjusted.

A particularly simple and compact structure of the hydraulic cylinder is obtained when the latter is designed to include a cup-shaped differential piston, wherein the effective area formed at the piston rear side and the effective area formed by a blind bore of the differential piston act in the advancing direction, whereas the annular surface of the differential piston acts in the direction of retraction.

Advantageously a pressure sensor is provided in the pressure line, which forms the input signal for the control apparatus which preferably operates electrically or hydraulically.

Further advantageous developments of the invention form the subject matters of the remaining subclaims.

Herebelow a preferred embodiment of the invention shall be explained in more detail by referring to the FIGURE which shows a connection diagram of a cylinder drive for a lifting gear.

This may, for example, be the lifting gear of a forklift or of a similar utility vehicle. The represented lifting gear includes a lifting cylinder 1, to the piston 2 there is applied a load F which may be moved by advancing or retracting the piston 2. The piston 2 is formed in differential construction and includes a blind inner bore 4 which communicates with the piston rear side, hereinafter referred to as the piston surface 6.

The piston 2 is guided in a cylinder jacket 8, which is formed in the shown embodiment with a center column 10 which coaxially extends through the inner cavity of the cylinder jacket 9 and plunges into the inner bore 4 of the piston 2.

As can be seen from the figure, the cylinder cavity surrounded by the cylinder jacket 8 is formed by the center column 10 as an annular space wherein the piston 2 is guided.

The radially widened collar portion 12 of the piston 2 is sealingly guided at the inner surfaces of the cylinder jacket 8 and through seals 14. In accordance with the figure, the piston rod-side portion 16 of the piston 2 has a cup-shaped cross-section and penetrates with its jacket surfaces an annular communicating recess 18 formed in the piston rod-side front surface of the cylinder jacket 8. In the communicating recess 18, in turn, sealing means 14 for sealing the cylinder cavity front surface are provided.

Owing to the above described configuration of the piston 2, three cylinder cavities 20, 22 and 24 are formed The first cylinder cavity 20 is limited in the radial direction by the cylinder jacket 8 and the center column 10, and in the axial direction by the lower internal front surface of the cylinder jacket 8 and by the piston surface 6. The second cylinder cavily 22 is formed by the front-side section of the inner bore 4 and the front surface at the center column 10. The third cylinder cavity 24 is limited by the annular surface 26 of the collar portion 12 of the piston 2 on the one hand and by the inner surface of the upper (representation in accordance with the figure) front surface of the cylinder jacket 8 on the other hand and by the outer circumference of the piston rod-side, radially stepped-back section 16 of the piston 2 and the inner peripheral surface of the cylinder jacket 8 on the other hand. The effective areas of the cylinder cavities are thus formed by the area A1 of the piston surface 6, the area A2 of the annular surface 26 and the front surface area A3 of the inner bore 4.

At the cylinder jacket a two ports 28 and 30 are formed which communicate with the cylinder cavities 20 and 24, respectively. The center column 10 of the cylinder jacket 8 is penetrated by an axial port bore 32 communicating with the second cylinder cavity 22.

The ports 28, 30 and the port bore 32 are connected to work lines 34, 36, 38 whereby the hydraulic fluid may be supplied to the respective cylinder cavities 20, 24 and 22. The work lines 34, 36, 38 are conveyed to three 3/2-distributing valves 40*a,b,c* having an essentially identical construction, which are biased into a basic position (not shown) by means of a spring. In this switching position a work port A is connected to a pressure port T of each distributing valve 40*a,b,c*.

The pressure ports P of the three distributing valves 40*a,b,c* are communicated via connecting lines to a common pressure line 42 which is connected to a port D of a proportional valve 44. In the shown end position of the proportional valve 44, port D is connected to a pump port P', whereas a tank port T is blocked. In the other end position of the proportional valve 44, port D is connected to a tank T.

To the pump port P' of the proportional valve 44 a pump line 46 is communicated which is connected to a variable displacement pump 48. A branch line toward a hydraulic accumulator 50 which may, for example, be designed in the form of a bubble reservoir, branches off from the pump line 46.

In the shown embodiment the distributing valves 40*a,b,c* have the form of electrically actuatable solenoid valves, such that upon excitation of the respective electromagnet 41 the distributing valve 40 is taken from the basic position into the shown switching position in which the respective port B is connected to a tank port T.

Control of the electromagnets 41 of distributing valves 40*a,b,c* is carried out through a control apparatus 52 whereby the distributing valves 40*a,b,c* may be selectively controlled. As an input signal for the control apparatus 52 in the shown embodiment, the signal of a pressure sensor 54 is used which detects the pressure in the pressure line 42 and emits a signal to the control apparatus 52.

In accordance with the present switching configuration, it is possible in the shown starting position (electromagnets 41 not excited, proportional valve 44 connects P'-D) to introduce hydraulic fluid from the pump 48 or from the hydraulic accumulator 50 via the proportional valve 44 and the distributing valves 40 into the cylinder cavities 20, 22 and 24, such that—in the case of a suitable system pressure—the load F may be displaced upwardly against the force acting on the annular surface 26 (A2) due to the forces acting on the areas A1 and A3.

The areas of effective areas A1, A2 and A3 are selected in such a way in the shown embodiment that:

$$A1=4\times A3$$

$$A1=2\times A2$$

and thus $$A2=2\times A3.$$

By corresponding control of the distributing valves 40, five pressure stages can be adjusted. In the switching condition represented in the figure, the overall effective area counteracting the load F is determined by the differential area $$A1+A3-A2$$

The additional switching variations can be found in Table 1, wherein the terms "ON" and "OFF" designate the states in which the respective electromagnet is excited (ON) (cf. figure) or disabled (OFF).

TABLE 1

| switching | valve 40a | | valve 40b | | valve 40c | | Effective |
|---|---|---|---|---|---|---|---|
| position | OFF | ON | OFF | ON | OFF | ON | area |
| 1 | x | | | x | x | | A3 |
| 2 | | x | x | | | x | A1 − A2 = 2A3 |
| 3 | | x | | x | | x | A1 − A2 + A3 = 3A3 |
| 4 | | x | x | | x | | A1 = 4A3 |
| 5 | | x | | x | x | | A1 + A3 = 5A3 |

In other words, by correspondingly controlling the distributing valves 40*a, b, c* it is possible to preselect five effective areas which amount to the 1- to 5-fold of the smallest area, i.e. the front surface area A3 of the inner bore 4.

Control of the distributing valves 40*a, b, c* is performed in such a way that—as shall be explained in more detail later on—a pressure which is approximately the same as the system pressure in the hydraulic accuinulator 50 is present in the pressure line 42. To this end, a table of nominal values is stared in the control apparatus, according to which the pressure in the pressure line 42 upon advancing of the piston 2 is lower by about the control pressure difference at the proportional valve 44 than the pressure in the hydraulic accumulator 50, and upon retraction of the piston 2 is higher by about the control pressure difference at the proportional valve 44 than the system pressure in the hydraulic accumulator 50. By this measure it is ensured that upon a displacement of hydraulic fluid from the cylinder cavities of the lifting cylinder 1, the latter can be conveyed back into the hydraulic accumulator 50 and need not be relieved into the tank while being "unused". In this way, energy consumption of the installation may be minimised quite considerably in comparison with conventional solutions, with only minimum expense in terms of device technology being required.

For a better understanding, the manner of functioning of the device according to the invention shall be explained herebelow.

For lifting an unknown load F, initially the switching position 5 is preselected in which the maximum effective area A1+A3 is preset, namely by exciting the electromagnets of distributing valves 40*a* and 40*b*, with the third cylinder cavity 24 not being supplied with hydraulic fluid as a result. In addition, the proportional valve 44 is taken into a position in which the ports D and P' are connected to each other, such that hydraulic fluid is introduced by the pump 48 or from the hydraulic accumulator 50 into the cylinder cavities 20 and 22, with the pressure in these cavities rising as a result until the load F is lifted. Immediately after lifting the load F, the pressure in the pressure line 42 is detected by the pressure sensor 54 and supplied on to the control apparatus 52 as an input signal. In the latter a comparison of the actual pressure in the pressure line 42 is carried out with a specified nominal value which is determined depending on the preset system pressure (accumulator pressure). Depending on the result of comparison, the distributing valves 40*a,b,c* are then controlled in such a way that—owing to suitable choice of the effective areas (A1 to A3 )—a pressure level is present in the pressure line 42 which is lower by about the control pressure difference than the system pressure in the pressure accumulator 50 (lifting). In order to lower the load F, the nominal value is modified such that the pressure manifesting in the pressure line 42 is higher by the control pressure difference than the pressure in the hydraulic accumulator 50.

The control apparatus 52 according to the invention also permits to balance short-term fluctuations in the retracting and advancing movements, wherein it is possible in accordance with the preset table of nominal values to react to pressure fluctuations possibly occurring in the pressure line 42 and thus in the cylinder cavities 20, 22 and 24 by switching the distributing valves 40*a, b, c* without any need for a considerable amount of hydraulic fluid having to be additionally conveyed by the pump 48.

In order to finally lower the piston 2 by correspondingly switching the valves 40*a,b,c* in the line 42, a pressure is adjusted which is higher by the control pressure difference in the valve 44 ($P_D$–$P_{P'}$) than the pressure in the hydraulic accumulator 50. By means of throttling in the valve 44 the piston 2 is lowered in a defined manner, with hydraulic medium flowing from D to P' into the accumulator 50. The switching position $\overline{DT}$ of the valve 44 is necessary in order to relieve the cylinder cavities 20, 22 and 24.

In the shown embodiment, the control apparatus has the form of an electrically operating means; the control apparatus may, of course, also be designed to operate hydraulically, wherein the distributing valves 40 can also be designed such as to be controlled hydraulically. Other configurations of the lifting cylinder 1 or of the shown valves are moreover also conceivable without exceeding the scope of the fundamental principle of the invention.

What is claimed is:

1. A method for controlling a multistage hydraulic cylinder of an implement, that acts on a load, including at least two selectively connectable active areas and being supplied with hydraulic fluid via a hydraulic pump, a hydraulic accumulator and a respective control valve assigned to each active area, said method comprising the steps of:

detecting an operating pressure in a pressure line leading to the hydraulic cylinder; and controlling each control valve of each active area of the hydraulic cylinder as a function of the detected operating pressure such that a resulting operating pressure corresponds to a target pressure that permits the hydraulic fluid to return from the hydraulic cylinder to the hydraulic accumulator.

2. The method according to claim 1, wherein the hydraulic cylinder is provided in a lifting mechanism of the implement, and wherein, during extension of the hydraulic cylinder, the target pressure substantially corresponds to a difference between pressure in the accumulator and a control pressure difference at the control valve, and during retraction of the hydraulic cylinder, the target pressure substantially corresponds to the sum of the pressure in the accumulator and the control pressure difference at the control valve.

3. A hydraulic system for an implement, said system including a hydraulic cylinder to which hydraulic fluid is suppliable from a hydraulic accumulator and/or a hydropump via a control valve for advancing, holding or retracting a piston, the hydraulic cylinder including a plurality of active areas that are selectively controllable for actuating the hydraulic cylinder, wherein a respective valve is assigned to each active area and a control apparatus is provided that controls the valves depending on the operating pressure in the pressure line leading to the hydraulic cylinder, said controlling being effected such that a resulting operating pressure corresponds to a target pressure that permits the hydraulic fluid to return from the hydraulic cylinder to the hydraulic accumulator.

4. The hydraulic system according to claim 3, wherein the hydraulic cylinder includes three active areas of which a first and a third active area act in a direction that extends the hydraulic cylinder, and of which a second active area acts in a direction that retracts the hydraulic cylinder, each active area being located in a respective cylinder cavity, respective ones of the valves being in communication with respective ones of the cylinder cavities, each cylinder cavity being in selective communication with the pressure line or with a tank via the respective valve.

5. The hydraulic system according to claim 4, wherein a ratio between the size of the said first, second and third active areas is as follows:

$$A1=4A3$$

$$A1=2A2.$$

6. The hydraulic system according to claim 4, wherein the piston of the hydraulic cylinder is formed as a cup-shaped differential piston, a rear side of the piston forming the first active area, an inner front surface of a blind bore of the differential piston forming the third active area, and an annular surface of a step-shaped, radial extension of the differential piston forming the second active area.

7. The hydraulic system according to claim 3, further comprising a pressure sensor provided in the pressure line, wherein a signal of the pressure sensor is used as an input signal for the control apparatus.

8. The hydraulic system according to claim 3, wherein the control apparatus is designed to operate hydraulically or electrically.

9. The hydraulic system according to claim 3, wherein each valve is a three-ports, two-positions valve.

* * * * *